US006181288B1

(12) United States Patent
Ivanov et al.

(10) Patent No.: US 6,181,288 B1
(45) Date of Patent: Jan. 30, 2001

(54) POLARIZATION COMPENSATING DEVICE FOR ANTENNA WITHIN A RADOME

(75) Inventors: Alex Ivanov, Acton, MA (US); Robert L. Moran, Rand, CO (US); Troy E. Plunk, Bedford, MA (US)

(73) Assignee: Raytheon Company

( * ) Notice: Under 35 U.S.C. 154(b), the term of this patent shall be extended for 0 days.

(21) Appl. No.: 05/727,732

(22) Filed: Sep. 29, 1976

(51) Int. Cl.[7] ..... H01Q 19/00

(52) U.S. Cl. ..... 343/756; 342/364; 342/366; 343/770; 343/872

(58) Field of Search ..... 343/708, 756, 343/909, 872, 770, 771, 768, 16 M; 342/364, 366

(56) References Cited

U.S. PATENT DOCUMENTS

| | | | | |
|---|---|---|---|---|
| 2,574,433 | * | 11/1951 | Clapp | 343/771 |
| 3,146,449 | * | 8/1964 | Serge et al. | 343/771 |
| 3,316,549 | * | 4/1967 | Hallendorff | 343/772 |

* cited by examiner

*Primary Examiner*—Theodore M. Blum
(74) *Attorney, Agent, or Firm*—Daly, Crowley & Mofford, LLP

(57) ABSTRACT

A polarization compensating device useful in correcting radome-induced polarization errors in a linearly polarized antenna in a missile is described.

2 Claims, 3 Drawing Sheets

POLARIZATION COMPENSATING DEVICE FOR ANTENNA WITHIN A RADOME

BACKGROUND OF THE INVENTION

This invention relates generally to missile seeker antennas and, more particularly, to a polarization compensator for such antennas which reduces the sensitivity of such antennas to radome-induced polarization errors.

As is known in the art of semiactive missile guidance, an illuminator may be used to direct a beam of electromagnetic energy toward a target (such as an aircraft), and a portion of such electromagnetic energy reflected from such a target back to a missile is intercepted and processed (here by using monopulse techniques) to derive guidance information to direct the missile to an intercept. For low altitude engagements, it is desirable to transmit vertically polarized electromagnetic energy and to utilize a vertically polarized seeker antenna in the missile in order to minimize the sensitivity of the seeker antenna to ground reflections by taking advantage of the fact that the reflectivity of the ground is less for vertically polarized electromagnetic energy than for horizontally polarized electromagnetic energy.

One known jamming technique based on transmitting cross-polarized signals from an aircraft is easily implemented to cause error in the guidance information derived in a missile. When the presence of a jamming signal of such nature is detected in the missile, a so-called "home-on-jam" mode of operation is initiated as a countermeasure to guide the missile toward the source of the jamming signal. In order that the home-on-jam mode of operation may be carried out with the greatest accuracy, provision must be made to compensate for the characteristics of the radome and the effect of such characteristics on monopulse techniques. Thus, if there were no radome, the response of the vertically polarized seeker antenna to a horizontally polarized jamming signal would be as much as 40 dB below the response to a vertically polarized signal and there would be no shift in the boresight axis of the antenna. However, in the presence of a radome having the shape of a conical ogive for aerodynamic purposes, a horizontally polarized wavefront experiences a degree of depolarization. Such depolarization produces a false, vertically polarized component which, in turn, results in a null in the antenna difference pattern which is displaced from the normal antenna boresight. It follows, then, that the vertical component created by the depolarization may cause angle tracking errors in the guidance information derived during the home-on-jam mode of operation against a jammer.

Radome-induced polarization errors during any mode of operation may be minimized by reducing the magnitude of the vertical component produced from a horizontally polarized jamming signal. One technique useful in reducing the magnitude of the vertical component produced from a horizontally polarized jamming signal or targets is to taper the sides of the radome perpendicular to the E-vector of the polarized energy, as is described in U.S. Pat. No. 3,314,070. While such a method may be effective in reducing the polarization errors experienced by signals in the plane of the tapers, the effectiveness of such tapers on signals incident on the intercardinal planes of the radome is not as pronounced. Another technique for the same purpose is to provide a radome having a thickness-to-wavelength ratio such that the transmission coefficients for both polarization components of a cross-polarized signal are very high and nearly equal. Such technique, however, requires a relatively heavy radome with a concomitant increase in weight of the missile.

Another technique useful in reducing the effect of any cross-polarized component in the echo signal received by a radar system is described in U.S. Pat. No. 3,805,268. Such a technique involves the use of a polarization-sensitive phase shifter applied to selected portions of the aperture of a reflecting antenna so as to produce similar primary and cross-polarized radiation patterns. Such a technique is, however, not well suited for use when the receiver antenna is a planar array.

SUMMARY OF THE INVENTION

With this background of the invention in mind, it is, therefore, an object of this invention to provide a means, in a semiactive missile guidance system using a monopulse radar operating through a radome, to reduce cross-polarization errors introduced by the radome.

Another object of this invention is to provide polarization compensator means particularly well suited for use with a planar array antenna using stripline.

These and other objects of the invention are generally attained by polarizing means in an antenna which provides an elliptically polarized planar array, as the antenna in a guided missile. Such polarizing means comprises a probe exciter located adjacent to each of the antenna elements in the planar array and disposed in a plane normal to the face of the planar array. The contemplated antenna, when mounted within a conical or ogival radome, is effective to compensate for any polarization twisting effect of the radome, thereby allowing echo signals to be processed in a conventional manner without any appreciable error.

BRIEF DESCRIPTION OF THE DRAWINGS

Other objects and many of the attendant advantages of the invention will be readily appreciated by reference to the following detailed description when considered in connection with the accompanying drawings wherein.

DESCRIPTION OF THE PREFERRED EMBODIMENT

Figures 1, 2:
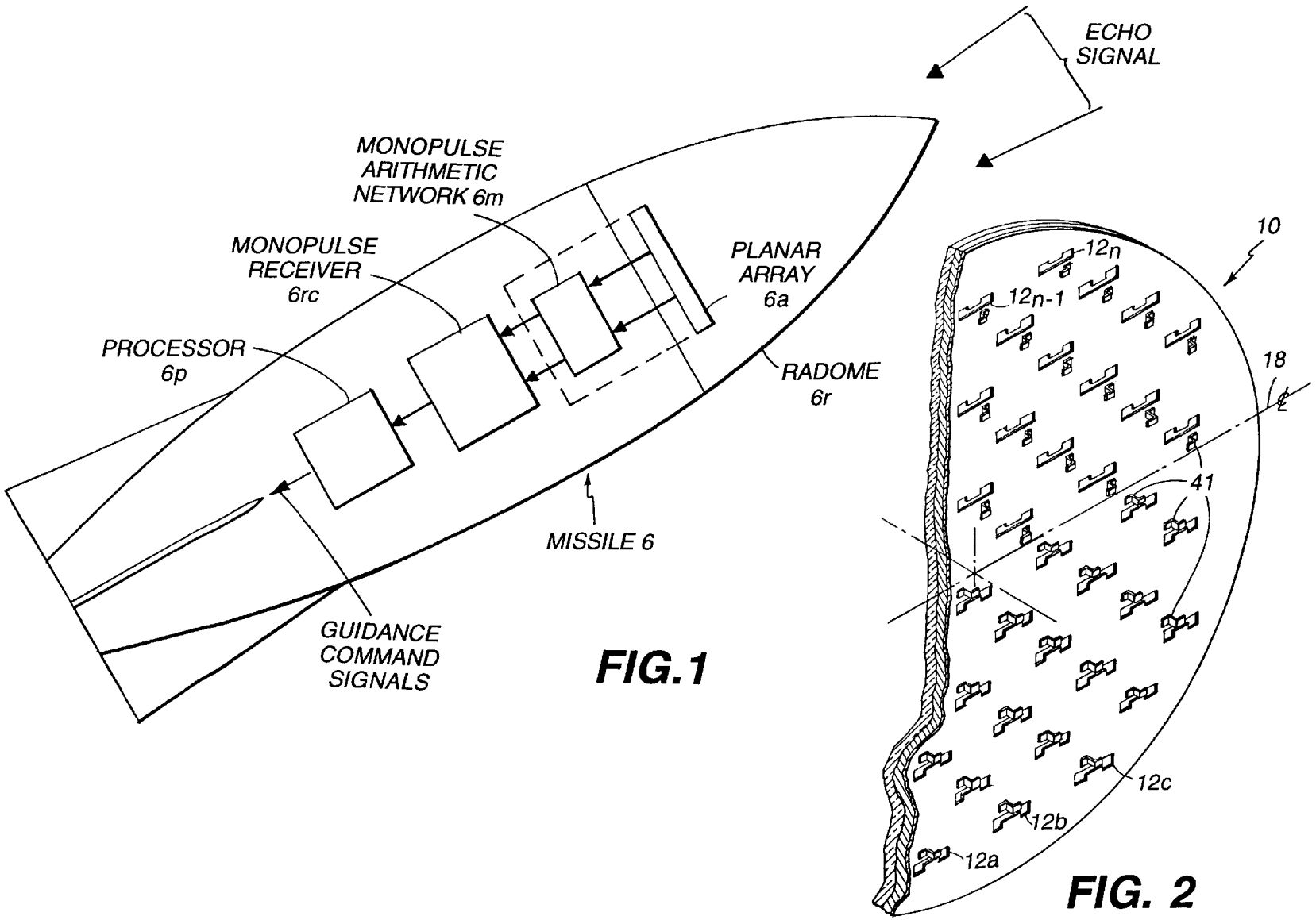
FIG. 1 is a sketch, greatly simplified, of a missile using a monopulse radar according to this invention.
FIG. 2 is an isometric drawing, partially cut away and somewhat simplified, of a monopulse antenna according to this invention.

Referring now to FIG. 1, it may be seen that a monopulse radar incorporated in a missile is, except as will be particularly pointed out hereinafter, conventional in design. Further, it may be seen that the remaining elements in the guidance system are conventional. Thus, in FIG. 1, a missile 6 with a conventional ogival radome **6*r* receives echo signals resulting from reflections of electromagnetic energy from a target (not shown but here assumed to be an aircraft in flight). The electromagnetic energy reflected from the target is here assumed to be vertically polarized to correspond with the polarization of electromagnetic energy from a radar (not shown) illuminating the target. The echo signals then illuminate a planar array 6*a* of antenna elements and are passed in a conventional manner through a monopulse arithmetic network 6***m* to a monopulse receiver 6*rc*. The signals out of the latter then are passed to a processor 6*p* to be used therein to derive guidance command signals to direct the missile 6 toward the target.

Referring to FIG. 2, the planar array 6*a* of FIG. 1 here is shown to be a flat-plate stripline antenna 10, suitable for use as a missile seeker antenna, and including an array of vertically polarized slot radiators $\mathbf{12}_a \ldots \mathbf{12}_n$, each one being of conventional design. Slot radiators $\mathbf{12}_a \ldots \mathbf{12}_n$ are disposed, in a known manner, to provide optimum antenna performance for the given aperture size. A corporate feed network (not shown) for feeding each of the slot radiators $\mathbf{12}_a \ldots \mathbf{12}_n$ and a monopulse arithmetic network (also not shown) for forming the monopulse sum (Σ) and difference (Δ) channel signals are disposed behind flat-plate stripline antenna 10 (hereinafter sometimes simply referred to as antenna 10). The flat-plate stripline antenna 10 also includes polarizing means 41 to be described hereinafter.

Figure 3A:
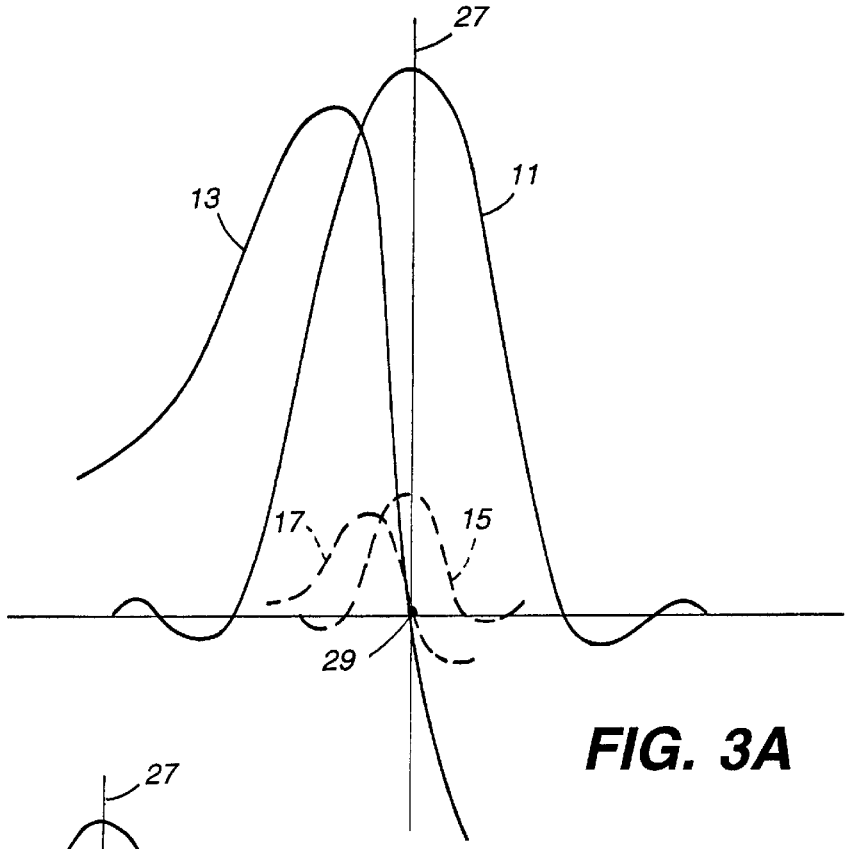
FIGS. 3A and 3B are sketches illustrating the effect of the radome on a conventional monopulse radar.
Figure 4A:
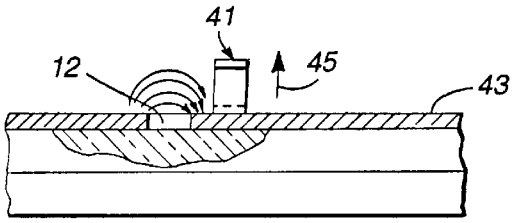
FIGS. 4A and 4B are sketches of a polarizing device according to this invention.
Figure 4B:
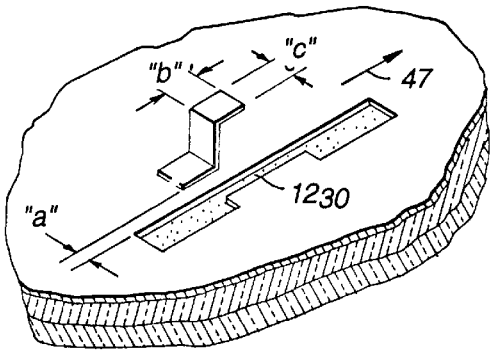

Referring to FIG. 3A, representative antenna patterns of the flat-plate stripline antenna 10 without a radome and not considering the effect of the polarizing means 41 of FIGS. 1, 4A and 4B are shown. The solid curves 11 and 13 represent, respectively, the outputs at the antenna sum (Σ) and elevation difference (ΔE1) ports with an incident vertically polarized signal. The peak of Σ port response, curve 11, and the "zero-crossing" point of the ΔE1 port response, curve 13, are shown to occur at the same angle which will hereinafter be referred to as the boresight axis 27 while the "zero crossing" point of the ΔE1 port response will be referred to as stable tracking point 29. The dashed curves 15 and 17 represent, respectively, the outputs at the antenna Σ and ΔE1 ports with an incident horizontally polarized signal. While the responses to an incident horizontally polarized signal are shown to be approximately 35 dB below the responses to an incident vertically polarized signal, the boresight axis 27, in the absence of a radome, is the same for either incident vertically or horizontally polarized signals.

Figure 3B:
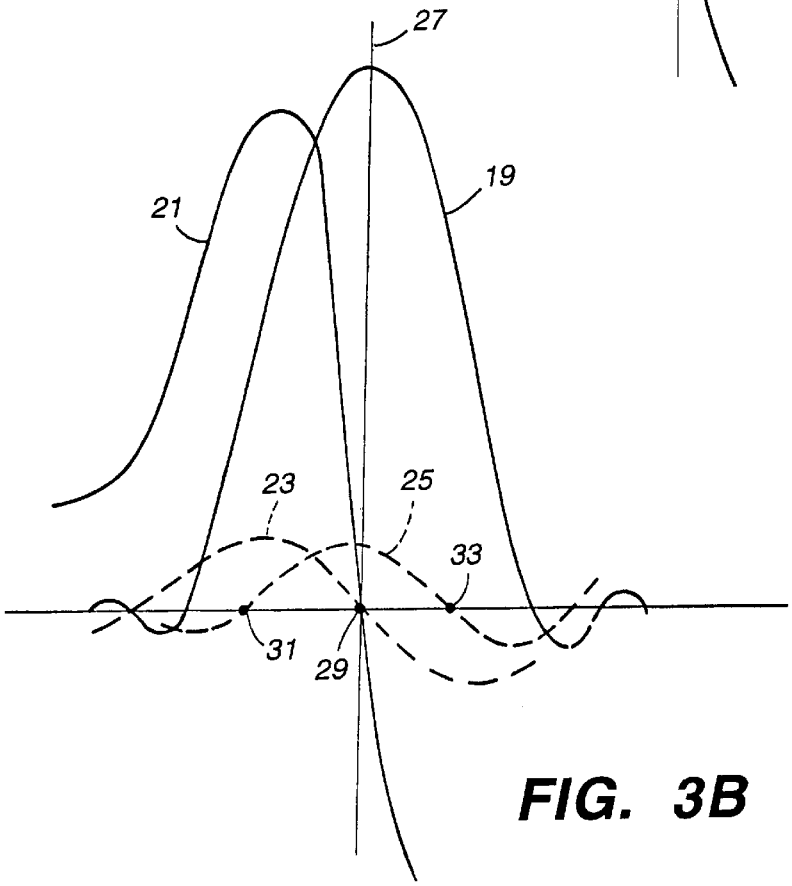

Referring now to FIG. 3B, the effect of a radome on representative antenna patterns, with conditions otherwise the same, may be seen. Again, the solid curves 19 and 21 represent, respectively, the outputs of the antenna Σ and ΔE1 ports with an incident vertically polarized signal, while the dashed curves 23 and 25 represent, respectively, the outputs of the antenna Σ and ΔE1 ports with an incident horizontally polarized signal. As may be seen from the dashed curves 23 and 25, the effect of the radome is such that neither the peak of the Σ port response nor the "zero-crossing" points of the ΔE1 port response occur on the boresight axis 27. Thus, as the target polarization rotates from vertical toward horizontal, the stable tracking point 29 changes from boresight toward a condition, represented by points 31, 33, of maximum error. It is this shift in the stable tracking point which can result in angle tracking errors as explained hereinabove.

Referring now to FIG. 4A, the electric field produced by an exemplary one of the slot radiators $\mathbf{12}_a \ldots \mathbf{12}_n$ (FIG. 2) is shown to extend across the exemplary slot. Polarizing means 41 (here a metal post), positioned adjacent an exemplary slot, is shown to intercept a portion of the electric field radiated from such slot. Polarizing means 41 is attached in any convenient manner, here by means of solder, to the ground plane 43 of stripline antenna 10 (FIG. 2). The intercepted portion of the electric field at polarizing means 41 will induce a current to flow in the direction of arrow 45. The current induced in polarizing means 41 will cause radiation in the direction of such current flow. By reciprocity, then, the assembly being described operates similarly as a receiving element.

Referring to FIG. 4B, it may be seen that polarizing means 41 has a right angle bend provided therein which results in the uppermost portion of polarizing means 41 extending in a direction parallel to the longitudinal dimension of the exemplary slot. The current induced in polarizing means 41 therefore causes radiation in a direction parallel to the longitudinal dimension of the exemplary slot, here in the direction of arrow 47, with the result that a horizontally polarized component of radiation is introduced. The magnitude and time phase of the induced, horizontally polarized component is controlled by the degree of coupling between the exemplary slot and polarizing means 41 which, in turn, is dependent upon the spacing between the polarizing means 41 and the exemplary slot, as well as the height and width of the polarizing means 41.

Figure 5:
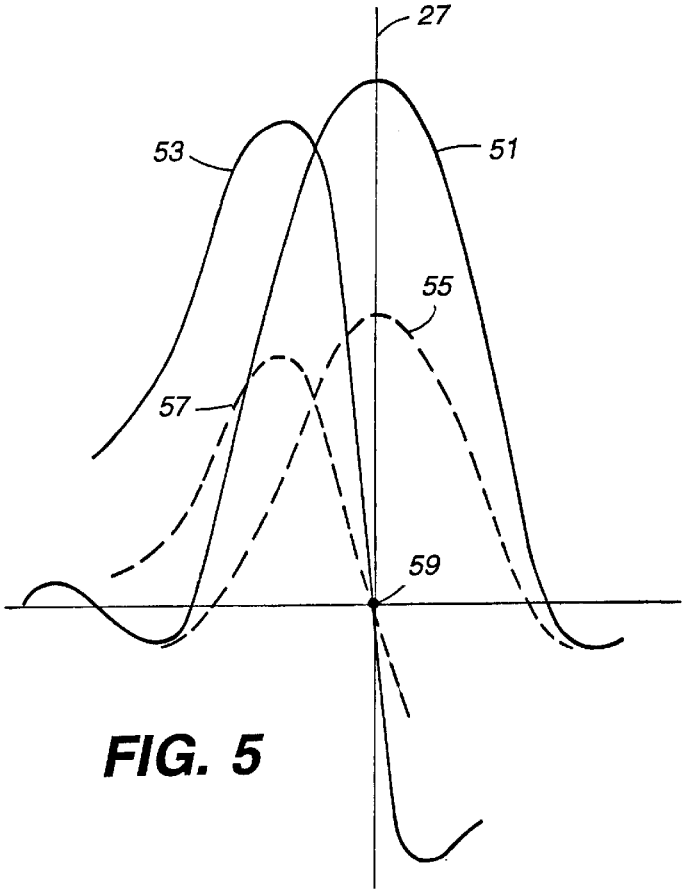
FIG. 5 is a sketch illustrating the effect of the polarizing means shown in FIGS. 4A and 4B on a monopulse radar incorporating such means.

Referring now to FIG. 5, representative antenna patterns, measured with a radome, for the antenna 10 of FIG. 2, after polarizing means 41 (FIG. 2) have been installed adjacent each of slots $\mathbf{12}_a \ldots \mathbf{12}_n$ (FIG. 2) are shown. The solid curves 51, 53 represent, respectively, the outputs at the antenna sum (Σ) and elevation difference (ΔE1) ports with an incident vertically polarized signal, while the dashed curves 55, 57 represent, respectively, that portion of the outputs at the antenna Σ and ΔE1 ports which are in time phase quadrature with an incident horizontally polarized signal. As may be seen, the magnitudes of the dashed curves 55, 57 are greater than that of the curves 23, 25 (FIG. 3B); however, the peak of the dashed curve 55 and the "zero-crossing" point of the dashed curve 57 both occur on the boresight axis 27 and provide a single stable tracking point 59.

Referring back now to FIG. 4B, the dimensions of polarizing means 41 which provided at a C-band frequency the responses shown in FIG. 5 were as follows:

| | |
|---|---|
| Dimension a | = 0.060 inches |
| Dimension b | = 0.150 inches |
| Dimension c | = 0.100 inches |
| Height of polarizing means 41 | = 0.150 inches |

It will now be appreciated that, with an antenna made up of an elliptically polarized planar array as disclosed, the antenna will respond to both vertically and horizontally polarized electromagnetic energy. If, however, the incident electromagnetic energy is horizontally polarized (thereby causing the depolarization effects discussed hereinbefore to be induced by the radome) the response of the antenna is greater to the horizontally polarized electromagnetic energy than to the vertically polarized electromagnetic energy caused by depolarization in the radome. Therefore, for example, when a jamming signal having horizontal polarization is being received, the signal actually tracked will be on the boresight axis.

Having described a preferred embodiment of this invention, it is now evident that other embodiments incorporating its concepts may be used. For example, if the flat-plate antenna were an array of waveguide slot radiators comprising slots in the broad wall of a waveguide, a cross-polarized component could be introduced by means of providing slots in the narrow wall of the waveguide. It is felt, therefore, that this invention should not be restricted to its disclosed embodiment, but rather should be limited only by the spirit and scope of the appended claims.

What is claimed is:

1. In a missile seeker having a monopulse antenna made up of an array of N linearly polarized antenna elements disposed behind a radome having the shape of an ogive, the shape of the radome causing an orthogonal component of polarization to appear in electromagnetic energy passing therethrough, which orthogonal component is effective to cause a shift in the monopulse null from the boresight axis of the antenna, the improvement comprising: polarization changing means disposed adjacent each of the N linearly polarized antenna elements for elliptically polarizing the array, such polarization changing means producing a linearly polarized component of electromagnetic energy at each of said antenna elements greater than the orthogonal component introduced when electromagnetic energy passes through the radome.

2. The improvement as in claim 1 wherein said polarization changing means comprises N metallic elements, each different one being a metallic post shaped as a right angle section, one arm of said section being parallel to the longitudinal dimension of its corresponding antenna element.

* * * * *